US007780150B2

(12) United States Patent
Yamazaki

(10) Patent No.: US 7,780,150 B2
(45) Date of Patent: Aug. 24, 2010

(54) FUEL SUPPLY DEVICE FOR ENGINE

(75) Inventor: Toshiyuki Yamazaki, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 270 days.

(21) Appl. No.: 12/174,665

(22) Filed: Jul. 17, 2008

(65) Prior Publication Data

US 2009/0051054 A1 Feb. 26, 2009

(30) Foreign Application Priority Data

Aug. 21, 2007 (JP) ..... 2007-214672

(51) Int. Cl.
*F02M 1/16* (2006.01)

(52) U.S. Cl. ..... 261/36.2; 123/495; 261/68; 261/70; 261/72.1; 440/88 F

(58) Field of Classification Search ..... 261/34.1, 261/36.2, 68, 70, 72.1, 72.2, DIG. 23; 123/495, 123/510, 517; 440/88 F
See application file for complete search history.

(56) References Cited

U.S. PATENT DOCUMENTS 2,102,476 A * 12/1937 Mennesson ..... 123/460
2,873,956 A * 2/1959 Zubaty ..... 261/69.1
3,187,732 A * 6/1965 Orner ..... 123/559.1
3,372,912 A * 3/1968 Benmore ..... 261/36.2
3,800,754 A * 4/1974 Carlson et al. ..... 123/73 CB
4,039,637 A * 8/1977 Grosseau ..... 261/36.2
4,109,626 A * 8/1978 Aono et al. ..... 123/701
4,112,901 A * 9/1978 Chapin et al. ..... 123/505
4,161,499 A * 7/1979 Floroff ..... 261/36.2
4,165,348 A * 8/1979 Nakamura ..... 261/36.2
4,173,958 A * 11/1979 Kato et al. ..... 123/514
4,374,785 A * 2/1983 Wyatt ..... 261/51
4,820,215 A * 4/1989 Mizusawa et al. ..... 440/88 R
4,821,688 A * 4/1989 Slattery ..... 123/73 AD
4,876,993 A * 10/1989 Slattery ..... 123/73 AD
4,937,018 A * 6/1990 Diener ..... 261/36.2
5,195,493 A * 3/1993 Re ..... 123/510
6,701,784 B1 * 3/2004 Matusek et al. ..... 73/313
7,690,342 B2 * 4/2010 Gliniecki et al. ..... 123/179.11
2004/0221836 A1 * 11/2004 Lahner et al. ..... 123/510

FOREIGN PATENT DOCUMENTS

JP 55-142958 A * 11/1980 ..... 261/36.2
JP 2717272 B2 2/1998

* cited by examiner

*Primary Examiner*—Richard L Chiesa
(74) *Attorney, Agent, or Firm*—Keating & Bennett, LLP

(57) ABSTRACT

A fuel supply device for an engine includes a fuel tank positioned such that, at least when the fuel tank is filled with fuel, a first fuel level in the fuel tank is higher than a minimum required second fuel level in a float chamber. A bypass passage that bypasses a fuel pump is provided, and an on-off valve is disposed in the bypass passage. The fuel supply device is capable of improving a starting characteristic of the engine during an off period of the fuel pump without increasing a head difference between the first and second fuel levels.

4 Claims, 3 Drawing Sheets

FUEL SUPPLY DEVICE FOR ENGINE

BACKGROUND OF THE INVENTION

1. Field of the Invention

The present invention relates to a fuel supply device for an engine, the fuel supply device including a fuel tank and a fuel pump for supplying fuel in the fuel tank to a carburetor of the engine.

2. Description of the Related Art

In some small outboard motors, for example, a fuel tank is disposed in a top cowling in which an engine is housed. In this structure, the fuel tank is positioned such that a fuel level in the fuel tank is higher than a fuel level in a float chamber in a carburetor so that fuel is supplied from the fuel tank to the carburetor using the head difference between the fuel levels.

Alternatively, a fuel pump can be disposed in the middle of a fuel supply conduit so that fuel can be supplied to the engine immediately and constantly even when the fuel levels have no head difference therebetween (see JP-B-2717272, for example).

However, when the fuel pump is disposed in the middle of the fuel supply conduit in a conventional fuel supply device, the fuel pump impedes the flow of the fuel through the conduit during an off period of the fuel pump, thereby obstructing fuel supply to the carburetor even when the head difference between the fuel levels is at a certain distance. Starting the engine for a first time or after a long interval takes a large amount of time because the carburetor contains no fuel therein. Particularly when the engine is started with a recoil starter, this can cause a user to incorrectly believe that the engine has failed.

Increasing the head difference between the fuel levels is expected to be effective in assuring that fuel is supplied to the carburetor before the fuel pump starts driving. However, due to restrictions such as the space necessary for providing the fuel tank, there is a limit on the distance by which the head difference can be increased.

SUMMARY OF THE INVENTION

In order to overcome the problems described above, preferred embodiments of the present invention provide a fuel supply device for an engine that can improve a starting characteristic of the engine by allowing automatic fuel supply to the carburetor before the fuel pump starts driving without increasing the head difference between the fuel levels by a great distance.

According to a first preferred embodiment of the present invention, a fuel supply device for an engine includes a carburetor disposed in an intake system of the engine; a fuel tank arranged to hold fuel to be supplied to the carburetor, the fuel tank being positioned such that, at least when the fuel tank is full with fuel, a fuel level in the fuel tank is higher than a minimum required fuel level in a float chamber of the carburetor; a fuel tank arranged to supply the fuel in the fuel tank to the carburetor; a bypass passage arranged to bypass the fuel pump; and an on-off valve provided in the bypass passage.

According to a second preferred embodiment of the present invention, the fuel supply device preferably includes a choke device arranged to be turned on when the engine is started and turned off after the engine has been started, in which the on-off valve includes an on-off mechanism to be opened or closed in accordance with the opening or closing operation of the choke device.

The choke device according to a preferred embodiment of the present invention may be a manually operated choke or an automatically operated choke.

According to a third preferred embodiment of the present invention, the bypass passage of the fuel supply device preferably includes a restricting portion.

In the fuel supply device according to the first preferred embodiment of the present invention, because the on-off valve is provided in the bypass passage that bypasses the fuel pump, the fuel can be supplied directly to the carburetor through the bypass passage before the fuel pump starts driving by opening the on-off valve when the engine is started. Hence, a starting characteristic of the engine can be improved without increasing the head difference between the fuel levels.

Because closing the on-off valve after the engine has been started causes the fuel pump to supply fuel to the carburetor, fuel can be constantly supplied to the carburetor even when the fuel level in the fuel tank declines.

According to the second preferred embodiment of the present invention, because the on-off valve is opened or closed in accordance with an on-off operation of the choke device, the need for performing an on-off operation of the on-off valve is eliminated thereby improving operability. More specifically, the choke device is generally turned on when the engine is started and turned off after the engine has been started. Therefore, the on-off valve is opened when the engine is started and closed after the engine has been started. Accordingly, the bypass passage is automatically opened to allow fuel to be supplied to the carburetor before the fuel pump starts driving, and after the engine has been started, the bypass passage is automatically closed to cause the fuel pump to supply fuel to the carburetor.

According to the third preferred embodiment of the present invention, because the restricting portion is provided in the bypass passage, when the engine is started with a low fuel level in the fuel tank and with the on-off valve open, an undesirable flow of fuel, which is fed by the fuel pump into the bypass passage, is minimized. Accordingly, fuel of a sufficient amount for starting the engine can be supplied to the carburetor. Furthermore, failures in supplying fuel by the fuel pump can be prevented even when a user forgets to close the on-off valve after the engine has been started. More specifically, in a state in which the bypass passage is open, the fuel fed by the fuel pump easily circulates to the fuel pump through the bypass passage, which can make it difficult to supply fuel to the carburetor. However, according to the third preferred embodiment of the present invention, because the bypass passage preferably includes the restricting portion, the circulation of the fuel is minimized, thereby allowing reliable fuel supply to the carburetor.

Other features, elements, steps, characteristics and advantages of the present invention will become more apparent from the following detailed description of preferred embodiments of the present invention with reference to the attached drawings.

DETAILED DESCRIPTION OF PREFERRED EMBODIMENTS

Preferred embodiments of the present invention will be described below with reference to the accompanying drawings.

Figure 1:
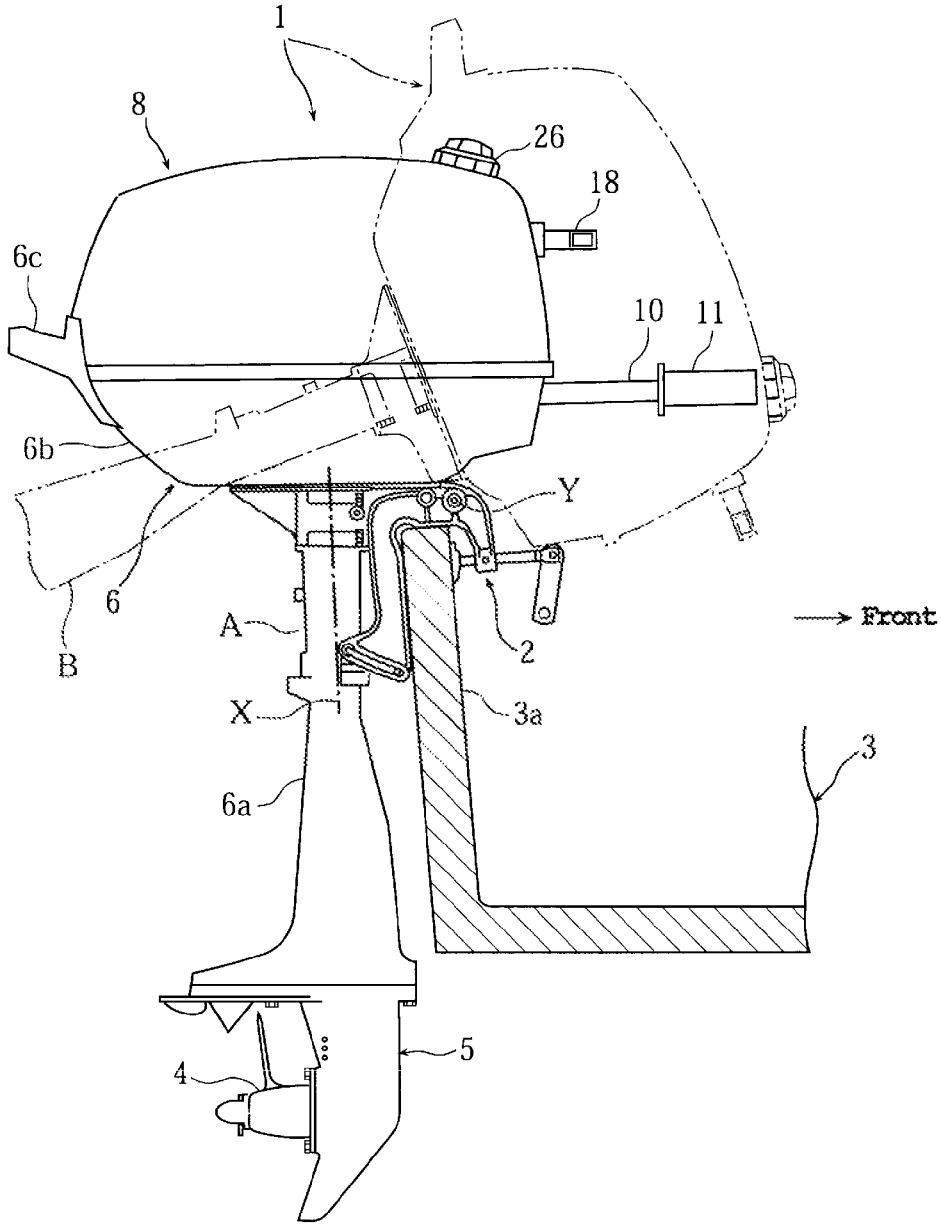
FIG. 1 is a side view of an outboard motor, on which a fuel supply device for an engine according to a preferred embodiment of the present invention is mounted.
Figure 2:
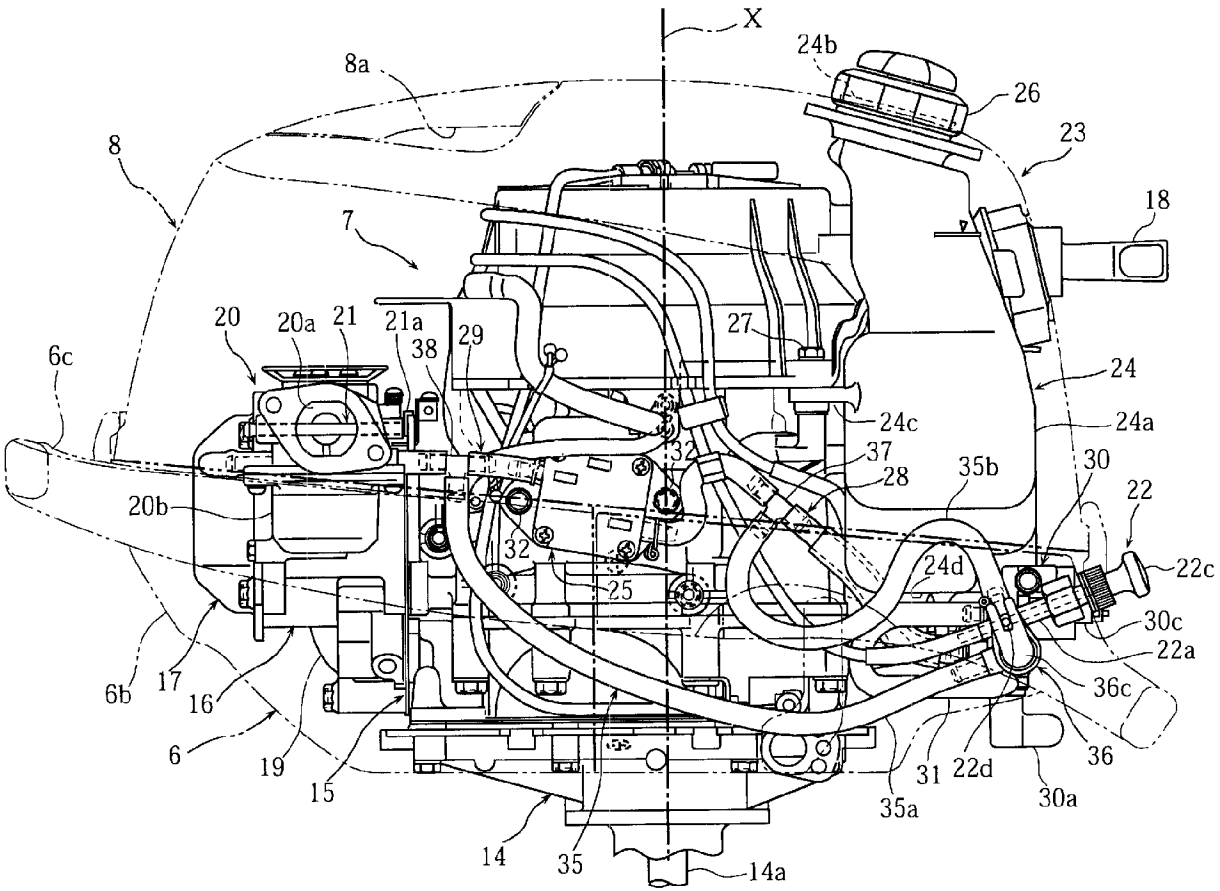
FIG. 2 is a side view of the engine.
Figure 3:
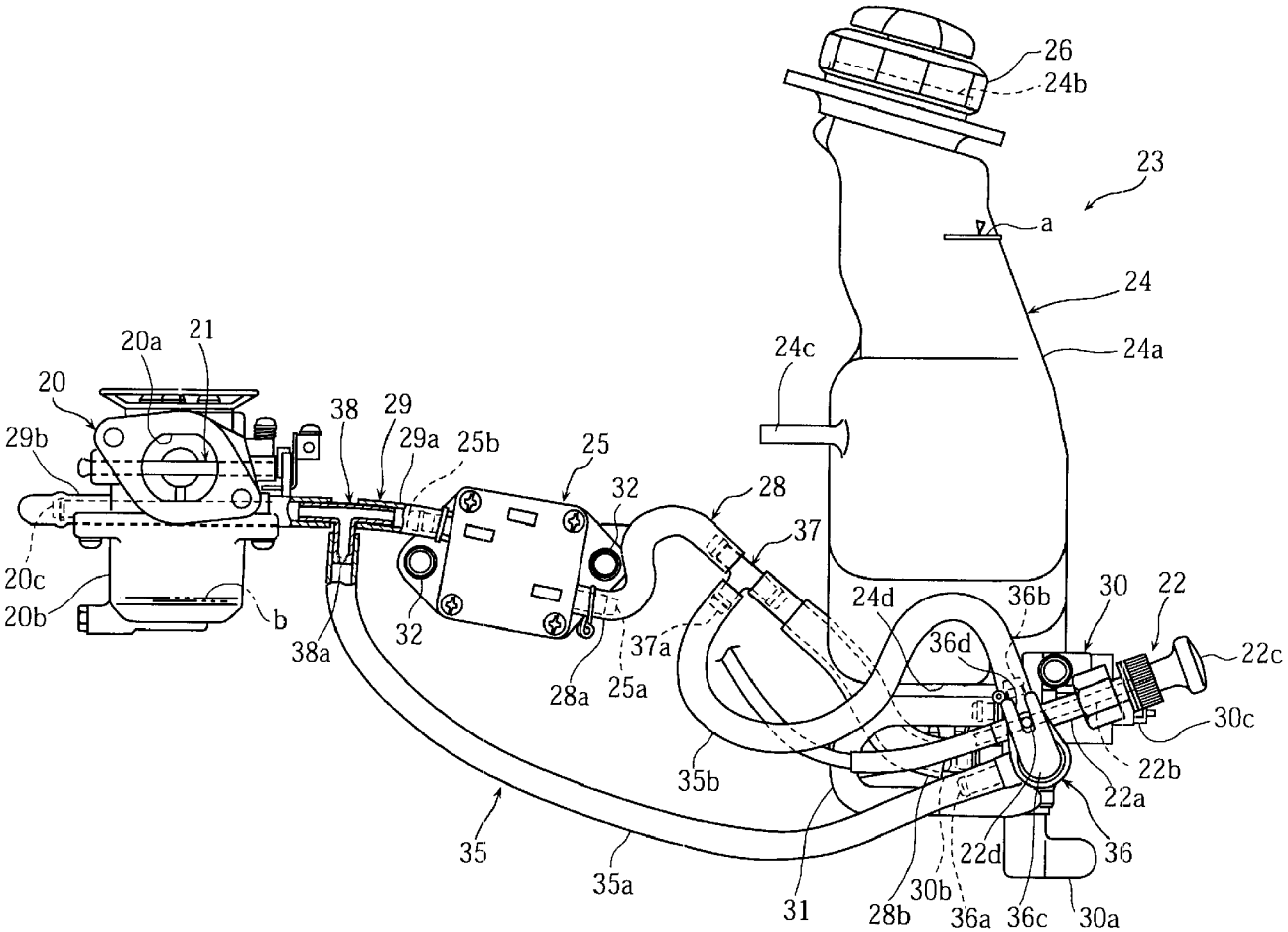
FIG. 3 is a side view of the fuel supply device.

FIGS. 1 to 3 are drawings for explaining a fuel supply device for an engine according to preferred embodiments of the present invention. FIG. 1 is a side view of an outboard motor, on which the engine is mounted. FIG. 2 is a side view of the engine. FIG. 3 is a side view of the fuel supply device. The terms front and rear, and left and right used in the description of the preferred embodiments refer to those as viewed from the rear side of a hull unless otherwise specified.

In the drawings, reference numeral 1 denotes the outboard motor. The outboard motor 1 is mounted on a stern 3*a* of a hull 3 with a clamp bracket 2 and supported to be rotatable about a pivot shaft X and tiltable about a tilt shaft Y between a running position A (the position indicated by solid lines in FIG. 1) and a tilt up position B (the position indicated by long dashed double-short dashed lines in FIG. 1).

The outboard motor 1 is held at the running position A during a running period and held at the tilt up position B when being moored and stored. To switch a running direction from forward to reverse, a clutch is used to shift to a reverse gear.

The outboard motor 1 includes a lower case 5 on which a screw 4 is disposed, an upper case 6 connected to the lower case 5 and containing a drive shaft (not shown) that transmits a rotational force of the engine to the screw 4, the engine 7 installed in the upper case 6, and a cowling 8 connected to the upper case 6 to cover the engine 7. An air duct 8*a*, through which outside air is inducted into the engine 7, is defined in the cowling 8 (see FIG. 2).

The upper case 6 includes a cylindrical lower casing 6*a*, in which the drive shaft is housed, and an upper casing 6*b* supporting the engine 7 and having an upwardly-open bowl shape. The cowling 8 is detachably attached to the upper casing 6*b*.

A rod-like steering handlebar 10 extending frontward of the hull is attached to the upper case 6. An acceleration grip 11 is attached to the steering handlebar 10.

A handle grip 6*c* to be actuated to tilt up the outboard motor 1 from the hull 3 is attached to the upper case 6.

The engine 7 is preferably a 4-cycle, single-cylinder engine, for example, and is preferably longitudinally arranged such that a crankshaft 14*a* extends substantially vertically during running. The crankshaft 14*a* is preferably coaxial with the pivot shaft X.

In the engine 7, a cylinder block 15, a cylinder head 16, and a head cover 17 are positioned to the rear of a crankcase 14 that houses the crankshaft 14*a* and are integrally connected to define the engine 7.

A starting pulley (not shown) is attached to the upper end of the crankshaft 14*a*. A starting rope 18 is wound around the starting pulley. The starting rope 18 projects frontward from the cowling 8. When the starting rope 18 is pulled, the crankshaft 14*a* is rotated, which starts the engine 7.

An exhaust system of the engine 7 has an exhaust passage 19 and an exhaust pipe (not shown). The exhaust passage 19 is connected to an exhaust port (not shown) having its opening in a bottom surface of the cylinder head 16. The exhaust pipe extending from the exhaust passage 19 is disposed in the upper case 6 and preferably has its opening underwater.

An intake system of the engine 7 has an intake passage (not shown) connected to an intake port, a carburetor 20 connected to the upstream side of the intake passage, and a silencer (not shown) connected to the carburetor 20. The intake port has its opening in the top surface of the cylinder head 16.

The carburetor 20 includes a venturi passage 20*a*, and has a throttle valve 21 that changes a flow area through the venturi passage 20*a* and a float chamber 20*b* for holding fuel therein. The accelerator grip 11 is coupled to the throttle valve 21 via a throttle cable 21*a*.

The engine 7 includes a choke device 22 to be turned on when the engine 7 is started to increase a fuel ratio in the air-fuel mixture supplied from the carburetor 20 thereby facilitating starting of the engine 7, and turned off after the engine 7 has been started to reduce the fuel ratio in the air-fuel mixture supplied from the carburetor 20 to a regular value. The choke device 22 includes a choke valve (not shown) for opening and closing a starting passage (not shown) of the carburetor 20, a choke cable 22*a* connected at one end to the choke valve, and a choke knob 22*c* connected to the other end of the choke cable 22*a*. The choke knob 22*c* is disposed on a front wall of the cowling 8.

When a user pulls the choke knob 22*c* to start the engine, the choke device 22 is turned on, opening the starting passage of the carburetor 20. When the choke knob 22*c* is pushed back, the choke device 22 is turned off, closing the starting passage.

The engine 7 has a fuel supply device 23. The fuel supply device 23 includes a fuel tank 24, which is preferably made of a resin or plastic and in which fuel is held, and a fuel pump 25 for supplying the fuel in the fuel tank 24 to the carburetor 20.

While an upstream fuel hose 28 connects the fuel tank 24 with the fuel pump 25, a downstream fuel hose 29 connects the fuel pump 25 with the carburetor 20. The upstream side and the downstream side of the fuel pump 25 is bypass connected through a bypass passage 35. An on-off valve 36 for opening and closing the bypass passage 35 is inserted into the bypass passage 35.

The fuel tank 24 is disposed at a position inside the cowling 8 and to the front of the crankcase 14. The fuel tank 24 has a tank body 24*a* extending vertically along a front wall of the crankcase 14 and a fuel filler port 24*b* provided at the top end of the tank body 24*a*.

A mounting boss 24*c* projecting rearwardly is provided on the tank body 24*a*. The boss 24*c* is fixed to the crankcase 24 with a bolt 27.

A fuel filler cap 26 is detachably attached to the fuel filler port 24*b*. The fuel filler cap 26 is upwardly exposed through the cowling 8.

The fuel pump 25 is preferably a diaphragm type pump driven by the engine 7. The fuel pump 25 is positioned substantially in the middle between the fuel tank 24 and the carburetor 20, substantially parallel therewith, and fixed to a side wall of the crankcase 14 preferably with a pair of bolts 32, 32, for example.

The fuel pump 25 has a suction opening 25*a* through which the fuel in the fuel tank 24 is suctioned, and a discharge opening 25*b* through which the fuel, suctioned and then pressurized, is discharged. A downstream end 28*a* of the upstream fuel hose 28 is connected with the suction opening 25*a*. An upstream end 29*a* of the downstream fuel hose 29 is connected with the discharge opening 25*b*. The downstream end 29*b* of the downstream fuel hose 29 is connected to a fuel inlet 20*c* defined in an upper portion of the float chamber 20*b*.

A switching valve 30 is connected to a bottom 24*d* of the tank body 24*a* of the fuel tank 24. When a switching cock 30*c* is rotated, the switching valve 30 is switched to one of a position for using the fuel in the fuel tank 24, a position for using fuel in an external fuel tank (not shown) mounted on the hull 3, and a position for stopping fuel supply to the carburetor 20.

The switching valve 30 has a fuel supply opening 30*b*, through which fuel is supplied to the carburetor 20. An upstream end 28*b* of the upstream fuel hose 28 is connected with the fuel supply opening 30*b*.

A fuel hose (not shown) extending from the external fuel tank is connected to the switching valve 30 via a connector 30*a* and an external fuel hose 31. When the switching cock 30*c* is rotated to the position for externally supplying fuel, fuel is supplied into the fuel supply opening 30*b* through the external fuel hose 31.

The fuel tank 24 is positioned such that, at least when the fuel tank 24 is full with fuel, a fuel level "a" in the fuel tank 24 is higher than a minimum required fuel level "b" in the float chamber 20*b* of the carburetor 20. When the flow resistance in the fuel passage in a range from the fuel tank 24 to the carburetor 20 is small, the fuel in the fuel tank 24 is automatically supplied into the float chamber 20*b* by the head difference between the fuel level "a" in the fuel tank 24 and the fuel level "b" in the float chamber 20*b*.

The bypass passage 35 has an upstream manifold 37 disposed substantially in the middle of the upstream fuel hose 28, a downstream manifold 38 disposed substantially in the middle of the downstream fuel hose 29, a downstream bypass hose 35*a* connecting the downstream manifold 38 with a fuel outlet port 36*a* of the on-off valve 36, and an upstream bypass hose 35*b* connecting a fuel inlet port 36*b* of the on-off valve 36 with the upstream manifold 37.

Restricting portions 37*a* and 38*a* are provided in a branch for the bypass passage 35 of the upstream manifold 37 and that of the downstream manifold 38, respectively. The flow areas of the restricting portions 37*a* and 38*a* are smaller than the flow areas of the branch of the upstream manifold 37 having its opening in the upstream fuel hose 28 and the branch of the downstream manifold 38 having its opening in the downstream fuel hose 29, respectively.

The on-off valve 36 is configured to be opened or closed in accordance with an opening or closing operation of the choke device 22.

The on-off valve 36 has a valve body 36*c* for opening and closing the fuel inlet port 36*b* of the on-off valve 36. A notch 36*d* is provided in the valve body 36*c*. An interlocking pin 22*d*, which is connected to an inner cable 22*b* of the choke cable 22 so as to move with the inner cable 22*b*, is engaged with the notch 36*d*. A slit (not shown) for accommodating a moving distance of the interlocking pin 22*d* is defined in an outer tube of the choke cable 22*a*.

When the choke knob 22*c* is pulled when starting the engine, the valve body 36*c* interlocked therewith is rotated clockwise, thereby bringing the fuel inlet port 36*b* into communication with the fuel outlet port 36*a*. Consequently, the fuel in the fuel tank 24 flows through the bypass passage 35 into the float chamber 20*b*. When the choke knob 22*c* is pushed back after warming up of the engine is completed, the valve body 36*c* is rotated counterclockwise thereby shutting off the communication between the fuel inlet port 36*b* and the fuel outlet port 36*a*.

Because the outboard motor 1 of the present preferred embodiment is to be mounted on a boat, neither a battery nor a starter motor is provided on the outboard motor 1. The outboard motor 1 is configured such that when the starting rope 18 is pulled, the crankshaft 14*a* is rotated which starts the engine 7.

When the engine is started for a first time or after a long interval, chances are high that the carburetor 20 contains no fuel therein. Hence, it has conventionally been necessary to pull the starting rope 18 repeatedly to supply fuel to the carburetor; that is, the engine is hard to start. This can disadvantageously result in having to determine if the engine has had a failure or is defective. Presumably, because the fuel pump 25 impedes flow through the fuel supply conduit, the head difference of the degree obtained from the configuration according to the present preferred embodiment is insufficient to supply fuel to the carburetor 20.

However, according to the present preferred embodiment, the bypass passage 35 that bypasses the fuel pump 25 is provided and the on-off valve 36 is disposed substantially in the middle of the bypass passage 35. Accordingly, when the choke knob 22*c* is pulled when the engine is started, the on-off valve 36 interlocked therewith is opened, allowing fuel to directly flow into the float chamber 20*b* of the carburetor 20 through the bypass passage 35 while bypassing the fuel pump 25. Consequently, the engine 7 can be started easily without increasing the head difference between the fuel levels, thereby improving a starting characteristic of the engine during an off period of the fuel pump 25.

When the choke knob 22*c* is pushed back after the engine 7 has been started, the on-off valve 36 is closed, and the fuel pump 25 driven by the engine 7 supplies fuel to the carburetor 20.

In the present preferred embodiment, the on-off valve 36 is constructed to open or close in accordance with an opening or closing operation of the choke device 22. Accordingly, while the bypass passage 35 is opened as the choke device 22 is opened when the engine 7 is started, the bypass passage 35 is closed when the choke device 22 is closed on completion of the warming up of the engine 7. As described above, because the bypass passage 35 is opened or closed in accordance with a usual on-off operation of the choke device 22 performed by a user when the engine is started, the need of independently operating the on-off valve 36 is eliminated, thereby improving operability.

In the present preferred embodiment, the restricting portions 37*a* and 38*a* are provided in the upstream manifold 37 and the downstream manifold 38 of the bypass passage 35, respectively. Accordingly, fuel can be supplied to the carburetor 20 by the fuel pump 25 without delay even when a user forgets to close the choke device 22 and thus forgets to close the on-off valve 36 after the engine has been started. More specifically, in a state in which the bypass passage 35 is open, the fuel fed by the fuel pump 25 undesirably flows to the fuel pump 25 through the bypass passage 35, which can make it difficult to supply fuel to the carburetor 20. However, according to the present preferred embodiment, because the restricting portions 37*a* and 38*a* are provided on the manifolds of the bypass passage 35, the circulation of the fuel through the bypass passage 35 is minimized, thereby allowing the fuel to be sufficiently supplied to the carburetor 20.

The preferred embodiments have described an example in which the fuel supply device is for an outboard motor. However, the fuel supply device of the preferred embodiments of the present invention can be applied to fuel supply devices for motorcycle engines, general-purpose engines, and the like.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A fuel supply device for an engine, the fuel supply device comprising:

a carburetor disposed in an intake system of the engine;

a fuel tank arranged to hold fuel to be supplied to the carburetor, the fuel tank being positioned such that, at least when the fuel tank is filled with fuel, a fuel level in the fuel tank is higher than a minimum required fuel level in a float chamber of the carburetor;

a fuel pump arranged to supply fuel to the carburetor when the engine is running;

a bypass passage arranged to bypass the fuel pump and supply fuel directly to the carburetor; and an on-off valve provided in the bypass passage and arranged to control a flow of fuel through the bypass passage.

2. The fuel supply device according to claim 1, further comprising a choke device arranged to be turned on when the engine is started and turned off after the engine has been started, wherein the on-off valve includes an on-off mechanism to be opened or closed automatically in accordance with an on-off operation of the choke device.

3. The fuel supply device according to claim 1, wherein the bypass passage includes a restricting portion.

4. The fuel supply device according to claim 3, wherein the restricting portion includes a narrower portion than the bypass passage.

* * * * *